US005239954A

United States Patent [19]

Boegner et al.

[11] Patent Number: 5,239,954

[45] Date of Patent: Aug. 31, 1993

[54] STARTER PROTECTION CIRCUIT

[75] Inventors: Karlheinz Boegner, Neuhausen/Fildern; Manfred Hirth, Perouse; Klaus Bolenz, Schwieberdingen, all of Fed. Rep. of Germany

[73] Assignee: Robert Bosch GmbH, Stuttgart, Fed. Rep. of Germany

[21] Appl. No.: 777,546

[22] PCT Filed: Mar. 9, 1990

[86] PCT No.: PCT/DE90/00172

§ 371 Date: Dec. 12, 1991

§ 102(e) Date: Dec. 12, 1991

[87] PCT Pub. No.: WO91/00960

PCT Pub. Date: Jan. 24, 1991

[30] Foreign Application Priority Data

Jul. 8, 1989 [DE] Fed. Rep. of Germany ..... 3922492

[51] Int. Cl.[5] ..... F02N 11/08

[52] U.S. Cl. ..... 123/179.3; 290/38 R; 318/473; 361/25

[58] Field of Search ..... 123/179.3, 179.1; 290/38 R; 361/25, 26, 29; 318/473

[56] References Cited

U.S. PATENT DOCUMENTS 4,389,692 6/1983 Sander et al. ..... 290/38 R
4,494,162 1/1985 Eyler ..... 123/179.1
4,674,344 6/1987 Kazino et al. ..... 361/29

*Primary Examiner*—Andrew M. Dolinar
*Attorney, Agent, or Firm*—Michael J. Striker

[57] ABSTRACT

A starter protection circuit for a starting device of an internal combustion engine of a vehicle has a thermoswitch assignable to a starter, a relay which is activated by the thermoswitch when the thermoswitch is operative and interrupts a starter operation and a relay operating key which after assumption of a cold switching state of the thermoswitch can operate again the starter.

12 Claims, 5 Drawing Sheets

STARTER PROTECTION CIRCUIT

BACKGROUND OF THE INVENTION

The present invention relates to a starter protection circuit for the starting device of an internal combustion engine of a vehicle, particularly a motor vehicle.

The internal combustion engines of vehicles, particularly of passenger-carrying motor vehicles and utility vehicles are equipped with an electrically operating starting device. Via a start switch to be operated by means of an ignition key, a starter relay can be operated which connects a starter to a battery of the vehicle and establishes a mechanical coupling between starter and internal combustion engine via a pinion arrangement. As soon as the internal combustion engine has started, the driver of the vehicle opens the start switch by releasing the ignition key as a result of which the starter relay drops out and the starter is taken out of operation. The starter is only suitable for a short-time operation, that is to say it can only withstand a warming caused by the relatively large starter current for the short time of a starting process. Thus, a starter failure (in most cases total loss due to overheating) will occur if, for example, the start switch "hangs up" since this leads to a continuous operation of the starter for which it is not designed.

SUMMARY OF THE INVENTION

Accordingly, it is an object of the present invention to provide a starter protection circuit which avoids the disadvantages of the prior art.

In keeping with these objects and with others which will become apparent hereinafter, one feature of the present invention resides, briefly stated, in a starter protection circuit which has a thermoswitch assigned to a starter and when operated, activating a relay interrupting the starter operation and after resumption of the cold switching state of the thermoswitch the starter can be operated again by means of a relay operating key.

When the starter protection circuit is designed in accordance with the present invention it has the advantage that when the start switch hangs up or similar, this will not lead to a destruction of the starting device, particularly its starter. If the starter is operated for an inadmissibly long period, for example due to a fault (particularly the hanging up of the start switch), a thermoswitch assigned to it operates. The operating of the thermoswitch due to a corresponding heating up of the starter has the consequence that a relay is operated which interrupts the starter operation. Thus, the starter is switched off before it destroys itself due to the developing heat. A relay operating key is provided so that the starter can still be operated again after a cooling time in spite of the hung-up start switch. This key can be preferably operated from the drivers seat. The operation causes the relay to switch so that the interruption of the starter operation is eliminated. Thus, the starter protection circuit according to the invention not only offers an overload protection for the starter but also provides the possibility of resuming an initially interrupted starter operation in spite of a fault.

In accordance with a further development of the invention, it is provided that the relay exhibits a self-holding circuit. Thus, the relay position interrupting the starter operation can be maintained by the self-holding circuit.

The relay operating key preferably has a normally-closed contact which is located in the self-holding switching circuit of the self-holding circuit. Operating the relay operating key interrupts the self-holding switching circuit so that the relay previously operated drops out again as a result of which a new starter operation is possible if the thermoswitch has resumed its cold switching state.

According to a preferred further development of the invention, the thermoswitch has a normally-open contact which operates when a limit temperature is exceeded. If the limit temperature is exceeded, this normally-open contact closes as a result of which the winding of the relay is excited and a switching state interrupting the starter operation is assumed. The thermoswitch can be directly coupled to the starter via a heat-conducting connection so that it detects the temperature of the starter and accordingly assumes its cold switching state or its hot switching state, respectively.

As an alternative, however, it is also possible that an operating current of a starter relay of the starter flows through the thermoswitch. The operating current activates the starter relay and thus the starter. This ensures that when the operating current occurs, the starter also operates so that a monitoring of the operating current is equivalent to a monitoring of the starter. It is preferably provided that the operating current itself heats up the thermoswitch so that the thermoswitch operates when a predetermined period of current flow is exceeded. Thus, the time of starter operation is monitored.

The arrangement can preferably be constructed in such a manner that the relay disconnects the supply voltage of the starter relay. As a result, the starter relay drops out so that the current to the starter supplied directly from the battery of the vehicle is interrupted.

It is advantageous if the relay exhibits a normally-open contact and a normally-closed contact, the normally-open contact being located in the self-holding switching circuit and the normally-closed circuit following the starter switch and being arranged in a circuit belonging to the starter relay. Via the normally-open contact mentioned, the relay holds itself in self-holding position for the interruption of the starter operation. The normally-closed contact removes the voltage from the starter relay.

The normally-open contact of the thermoswitch is connected in parallel with the normally-open contact of the relay so that the relay is excited when the thermoswitch operates and—after a cooling phase—the relay is kept in self-holding position via the normally-open contact assigned to it even though the normally-open contact of the thermoswitch has returned to its open position.

According to another illustrative embodiment of the invention, the thermoswitch is constructed as a change-over switch. Its change-over contact is located in series with the start switch, its pole which is connected to the change-over contact in the cold switching state is connected to the starter relay, via a normally-closed contact of the relay and its pole which is connected to the change-over contact in the hot switching state leads to the winding of the relay. In the cold switching state of the thermoswitch, the starter relay is accordingly supplied via the normally-open contact. If the relay operates due to the thermoswitch operating, the normally-closed contact interrupts the circuit leading to the starter relay, that is to say starter operation is interrupted. At the same time, the normally-open contact then keeps the relay in the operated position via a self-holding circuit. In this self-holding circuit, a normally-closed contact of a relay operating key is located so that, when this is operated, the relay can be returned to its dropped-out position and a new starter operation can take place after the thermoswitch has assumed the cold switching state.

According to a further embodiment of the invention, it is provided that the thermoswitch exhibits a normally-closed contact. Its one first pole is connected to its ignition switch and the other second pole of which is connected via a normally-closed contact cf the relay, to the starter relay and one end of the winding of the relay is connected to the second pole and the other end of the winding is connected via the normally-closed switch of the relay operating switch to the starter-side pole of the start switch. For starter operation, the starter relay is supplied via the thermoswitch and the normally-closed contact of the relay. The winding of the relay in this case is in the non-excited state since both winding connections are approximately of the same potential. If the thermoswitch operates, that is to say its normally-closed contact opens, the direct connection between the starter-side pole of the start switch and the windings of the starter relay is interrupted and an indirect connection is created. This leads via the normally-closed contact of the relay operating key, the winding of the relay (possibly also via the filament of a pilot lamp connected in parallel with the relay winding) to the starter relay. The system is then designed in such a manner that the relay indeed operates due to the current flowing via this indirect connection but the starter relay drops out due to the series resistance formed by the relay winding. Thus, the relay is operated in this state but the starter operation is interrupted. When the thermoswitch closes again after a cooling time, the described switching state of the relay is retained due to the normally-closed contact of the relay which is located in series with the thermoswitch. If the starter is then to be operated again by means of the relay operating key, the opening of the normally-closed contact of the relay operating key causes a release of the relay as a result of which the starter relay is activated via the thermoswitch and the normally-open contact of the relay which is now in its closed position.

According to a different development of the invention, it is finally provided that the thermoswitch exhibits a normally-open contact. Its one pole leads to a battery of the vehicle, preferably to its positive pole, and its other pole leads to one set of connections of an operating and a holding winding of the relay. The that the other connection of the holding winding is connected via the normally-closed contact of the relay operating switch to the starter-side pole of the start switch which also leads via a normally-closed contact of the relay to the starter relay, and the other connection of the operating winding is connected to the battery, preferably to its negative pole. In normal operation, the starter relay—activated by the start switch—becomes a connection which supplies via the normally-closed contact of the relay. In this condition, a connection exists—starting from the starter-sidepole of the start switch—which extends via the normally-closed contact of the relay operating switch, the holding winding and (back) via the operating winding to earth. Since, however, holding winding and operating winding are of bifilar construction, the relay is not operated when a connection is established with the positive pole of the battery via the start switch, the negative pole of the battery being connected to earth. The operation of the thermoswitch leads to the operating winding of the relay being excited. The holding winding is not excited since an approximately equally large potential is connected to its two connections—for example due to the closed start switch hanging up. The relay therefore switches as a result of which the voltage is removed from the starter relay via its assigned normally-closed contact. The starter operation is thus interrupted. The operated position of the relay is retained even when the thermoswitch opens again since—as described before—a circuit exists which extends via the holding winding and via the operating winding. Due to the bifilar construction, this circuit cannot indeed cause the relay to operate but the current flowing is sufficient for holding the already operated relay in the operated position. Thus, the relay position assumed is also retained even after the thermoswitch has opened due to cooling. If, however, the starter is to be operated again, the opening of the relay operating switch has the result that the voltage is removed from the winding of the relay. The relay thus drops out and its normally-open contact again connects voltage to the starter relay of the starter.

It is advantageous if the relay position is indicated by a pilot lamp. This will always inform the driver about the current operating status.

The novel features which are considered as characteristic for he invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
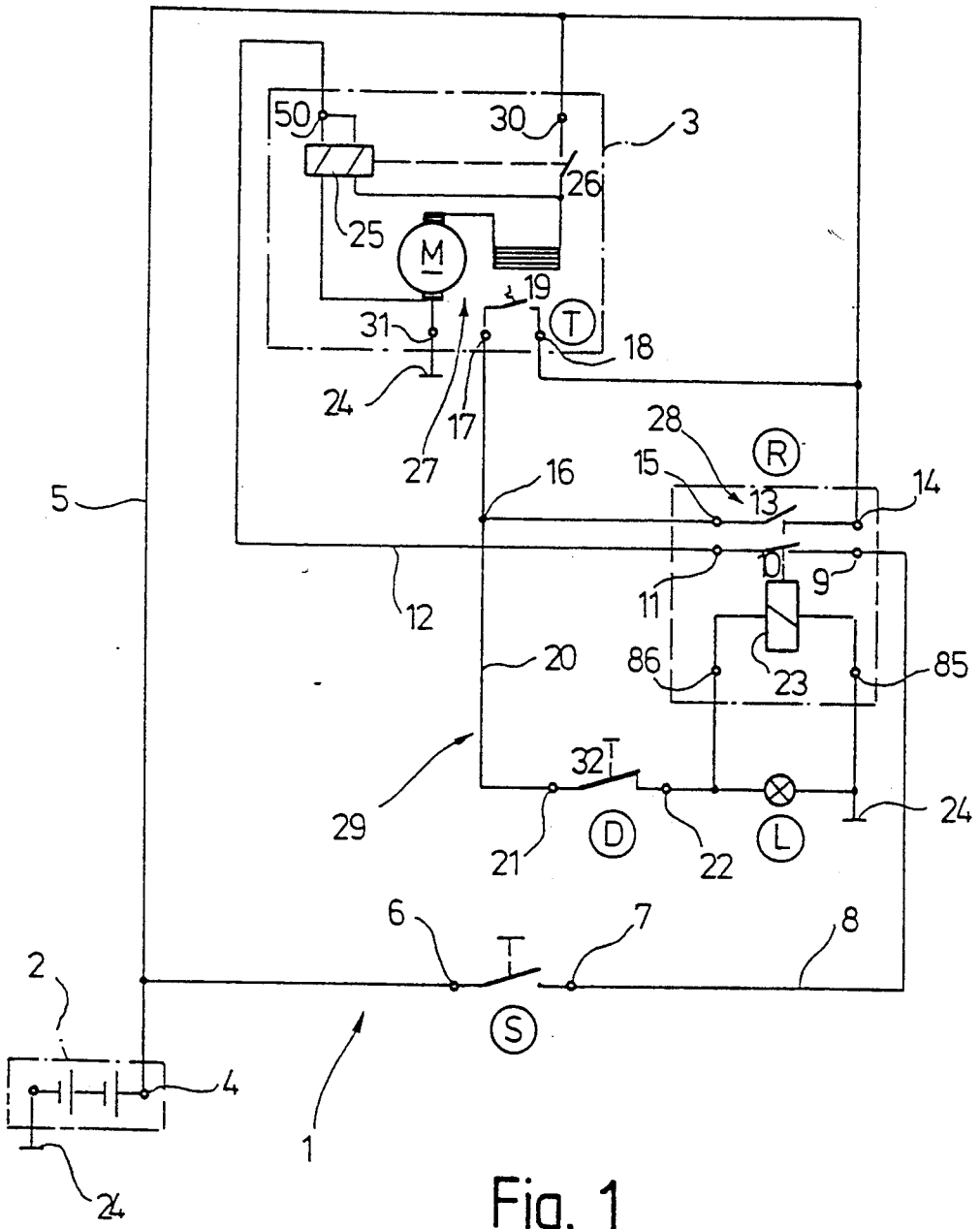
FIG. 1 shows a starter protection circuit for a starting device of an internal combustion engine of a vehicle.

A starter protection circuit 1 of FIG. 1 is connected to a battery 2 of a vehicle, not shown, and acts in conjunction with a starter 3 of an internal combustion engine, also not shown in greater detail, of the vehicle. The positive pole 4 of the battery 2 is connected via a line 5 to a terminal 30 of the starter 3. Furthermore, the positive pole 4 is connected to a battery-side pole 6 of a start switch S which is located on the dashboard of the vehicle and can be operated by means of the ignition key. The other starter-side pole 7 is connected via a line 8 to a relay R. The line 8 leads to a connection 9 of a normally-closed contact 10 of the relay R. The other connection 11 of the normally-closed contact 10 is connected to a line 12 which leads to a terminal 50 of the starter 3.

Furthermore, the relay R has a normally-open contact 13, one connection 14 of which is connected to the terminal 30. The other connection 15 of the normally-open contact 13 leads to a junction 16 to which one pole 17 of a thermoswitch T is connected. The other pole 18 of the thermoswitch T leads to the connection 14. Thus, the thermoswitch T constructed as normally-open contact 19 is connected in parallel with the normally-open contact 13 of the relay R.

The junction 16 leads via a line 20 to one pole 21 of a relay operating key D. The other pole 22 is connected to a terminal 86 of the winding 23 of the relay R. The other winding end is connected to a terminal 85 which is connected to earth 24. A pilot lamp L is connected in parallel with the winding 23 of the relay R.

The starter 3 has a starter relay 25 which operates a normally-open contact 26 by means of which the starter motor 27 can be connected to the terminal 30. A terminal 31 of the starter motor 27 is connected to earth 24.

The following operation is performed:

If the start switch S is operated by the driver of the vehicle by means of the ignition key in normal operation, the starter relay 25 is activated via the line 8, the normally-closed contact 10 and the line 12 so that the normally-open contact 26 closes and the starter 3 commences operation for starting the internal combustion engine. Once the internal combustion engine has started, the driver releases the ignition key and as a result the start switch S resumes its open state so that the starter relay 25 drops out and the starter 3 stops operation.

If the starter relay 25 should remain continuously excited due to a fault, particularly due to a hanging-up of the start switch S, the thermoswitch T will operate due to the heat developing in the starter motor 27, that is to say its normally-open contact 19 moves into closed position. As a result of this, the positive pole 4 of the battery 2 is connected via the normally-open contact 19 and the relay operating key D to the terminal 86 and as a result the winding 23 of the relay R is excited. At the same time, the pilot lamp L lights up.

The consequence of the operating of the relay R is that the normally-closed contact 10 opens and the normally-open contact 13 closes. As a result of this, the voltage is removed from the starter relay 25 (via the normally-closed contact 10) so that the starter 3 stops its operation. Due to the normally-open contact 13, the terminal 86 remains connected to the positive pole 4 of the battery 2 even when-after a cooling phase-the normally-open contact 19 of the thermoswitch T resumes its open position, that is to say its cold switching state. Thus, the relay R exhibits a self-holding circuit 28.

Since the relay operating key D constructed as normally-closed contact 32 is located in the self-holding switching circuit 29 thus formed in the self-holding circuit 28, the relay R can be released by operating this "key which preferably is possible from the driver's seat and as a result—due to the faulty start switch S being in the closed position, the starter relay 25 is again activated via the normally-closed contact 10 so that starter operation can be resumed.

Figure 2:
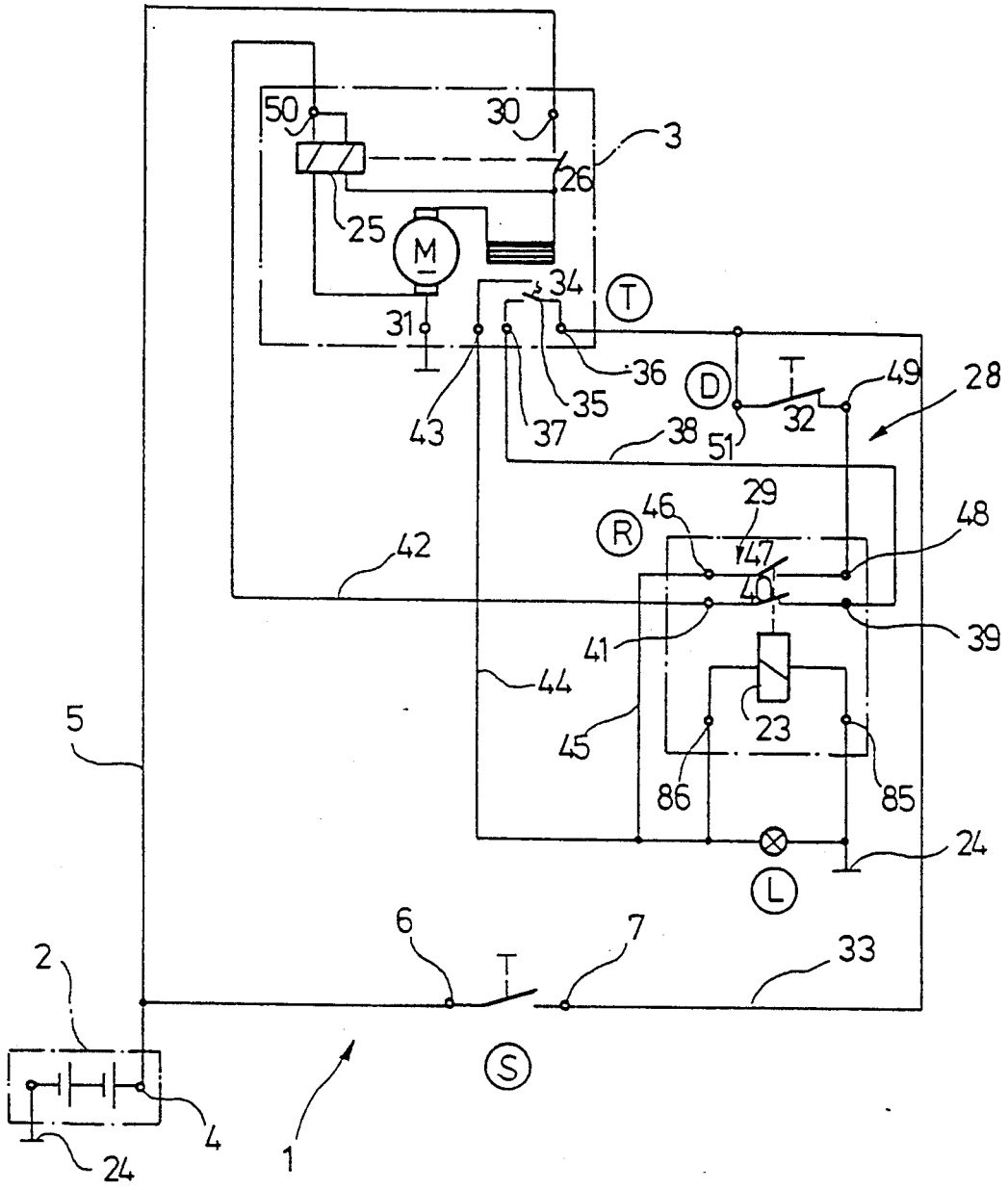
FIG. 2 shows a further illustrative embodiment of a starter protection circuit, FIG. 3 also shows a further illustrative embodiment of a starter protection circuit.

FIG. 2 shows a further illustrative embodiment of a starter protection circuit 1, identical parts being provided with identical reference symbols. This correspondingly also applies to the further FIGS. 3 to 5 explained in further detail in the text which follows. Furthermore, only the difference from the circuit of FIG. 1 will be described in each case in the description of FIGS. 2 to 5.

As can be seen from FIG. 2, the starter-side pole 7 of the start switch S is connected via a line 33 to the thermoswitch T which exhibits a change-over switch 34. The change-over contact 35 of the change-over switch 34 is connected to a terminal 36 to which, furthermore the line 33 is led. A pole 37 of the thermoswitch T which is connected to the change-over contact 35 in the cold switching state, is connected to a connection 39 of a normally-closed contact 40 of the relay R via a line 38. The other pole 41 of the normally-closed contact 40 is connected to a line 42 which leads to the terminal 50.

A pole 43 of the thermoswitch T, which is connected to the change-over contact 35 in the hot switching state, leads via a line 44 to the terminal 86 of the winding 23 of the relay R. The terminal 86 is furthermore connected via a line 45 to a connection 46 of a normally-open contact 47 of the relay R, the other connection 48 of which leads to one pole 49 of the relay operating key D which is constructed as normally-closed contact 32, the other pole 51 of which leads to the terminal 36. If the starter 3 remains in operation for too long a period due to a fault, then the change-over contact 35 of the thermoswitch T switches over so that the potential of the positive pole 4 of the battery 2 is supplied to the terminal 86 of the relay R via the start switch S and the thermoswitch T, which is in the hot switching state. As a result, the relay R operates so that the normally-closed contact 40 opens and disconnects the starter relay 25. At the same time, the normally-open contact 47 closes, as a result of which the relay R remains operated. Thus, this is also a self-holding circuit 28 which exhibits a self-holding switching circuit 29.

Due to the disconnection of the starter 3, the thermoswitch T cools off again so that the change-over contact 35 resumes its cold switching state so that a connection exists between the terminal 36 and the pole 37. This does not lead to a new operation of the starter relay 25 since the normally-closed contact 40 is in the opened state. To operate the starter again, it is now possible to carry out a new starter operation by operating the normally-closed contact of the relay operating key D—in spite of the fault—since, as a result, relay R drops out so that a connection is created to the starter relay 25 via the start switch S, the thermoswitch T and the normally-closed contact 40.

Figure 3:
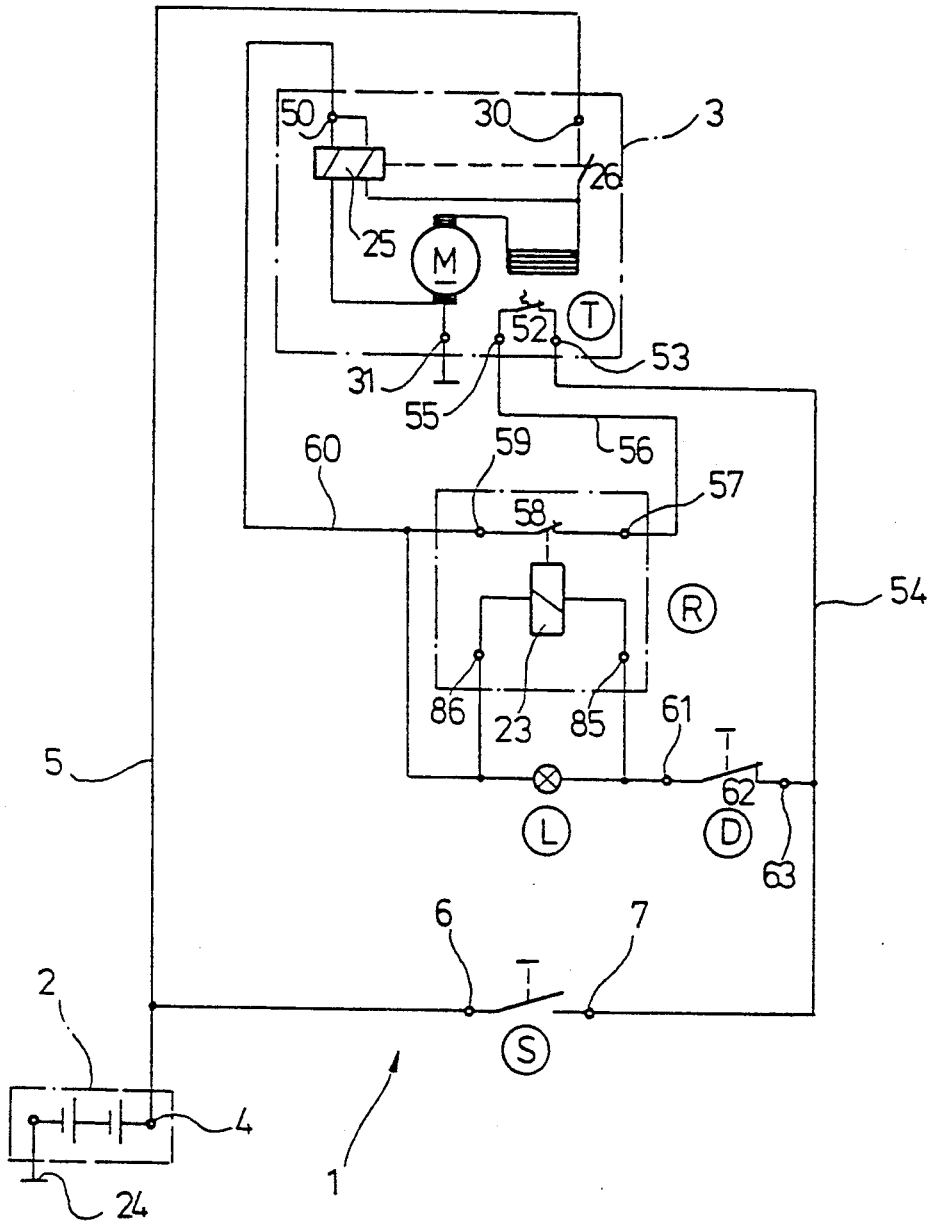

The illustrative embodiment of FIG. 3 shows a thermoswitch T which has a normally-closed contact 52. One pole 53 of the normally-closed contact 52 is connected via a line 54 to the starter-side pole 7 of the start switch S. The other pole 55 of the normally-closed switch 52 is connected to a line 56 which leads to a connection 57 of a normally-closed contact 58 of the relay R, the other connection 59 of which is connected via a line 60 to the terminal 50 of the starter 3. The terminal 50 is furthermore connected to the terminal 86 of the relay R. The terminal 85 of the winding 23 of the relay R leads to one pole 61 of the relay operating key D, which is constructed as normally-closed contact 62, the other pole 63 of which is connected to the pole 7 of the start switch S.

The starter protection circuit of the illustrative embodiment of FIG. 3 has the following operation:

By closing the start switch S, the starter relay 25 is activated in normal operation via the normally-closed contact 52 of the thermoswitch T and the normally-closed contact 58 of the relay R. In the case of a fault, the normally-closed contact 52 of the thermoswitch T opens due to overheating so that the current path to the starter relay 25 is interrupted. As a result, the starter 3 stops operating.

As long as this thermoswitch T is in its cold switching state (according to FIG. 3), the connections of the winding 23 of the relay R (terminals 85 and 86) are bypassed. However, as soon as the thermoswitch T assumes its hot switching state, as previously mentioned, in which the normally-closed contact 52 interrupts the bypass, a connection exists between the positive pole 4 of the battery 2 and the terminal 50. This connection extends via the start switch S, which is in the closed position, the normally-closed contact 62 of the relay operating key D and the winding 23 (and parallel thereto also via the pilot lamp L). The current flowing via this connection is sufficient for holding the relay R in its operated state; however, it is not large enough for holding the starter relay 25 in the operated state. Thus, this relay drops out since the winding 23 of the relay R forms a series resistance for the winding of the starter relay. Due to the operated state of the relay R, the normally-closed contact 58 assumes its opened position so that the starter relay 25 remains released even when the normally-closed contact 52 of the thermoswitch T closes again due to cooling.

If the starter is to be operated again in spite of a fault, the relay operating key D is pressed, and as a result voltage is removed from relay R and the normally-closed contact 58 returns to its closed state. The starter relay 25 then operates again so that a starting process occurs.

Figure 4:
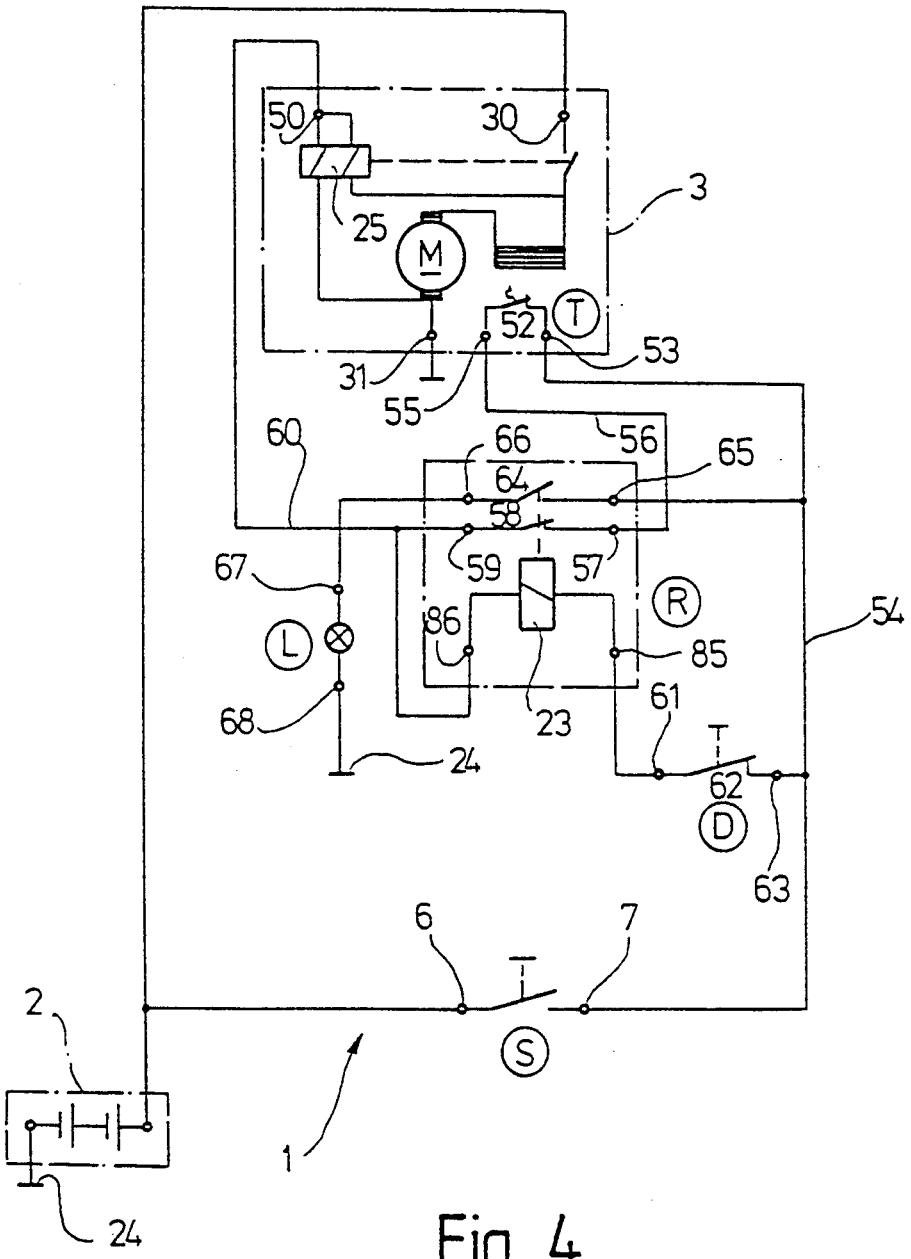
FIG. 4 shows the starter protection circuit according to FIG. 3 but with a modified pilot lamp circuit.

The starter protection circuit of FIG. 4 essentially corresponds to the configuration of FIG. 3. In distinction from the latter, only a further relay contact is provided which is constructed as normally-open contact 60, one connection 65 of which leads to the starter-side pole 7 of the start switch S and the other connection 66 of which is connected to one pole 67 of the pilot lamp L. The other pole 68 of the pilot lamp L is connected to earth 24. In this respect, the pilot lamp L is operated via a separate normally-open contact 64 of the relay R.

Figure 5:
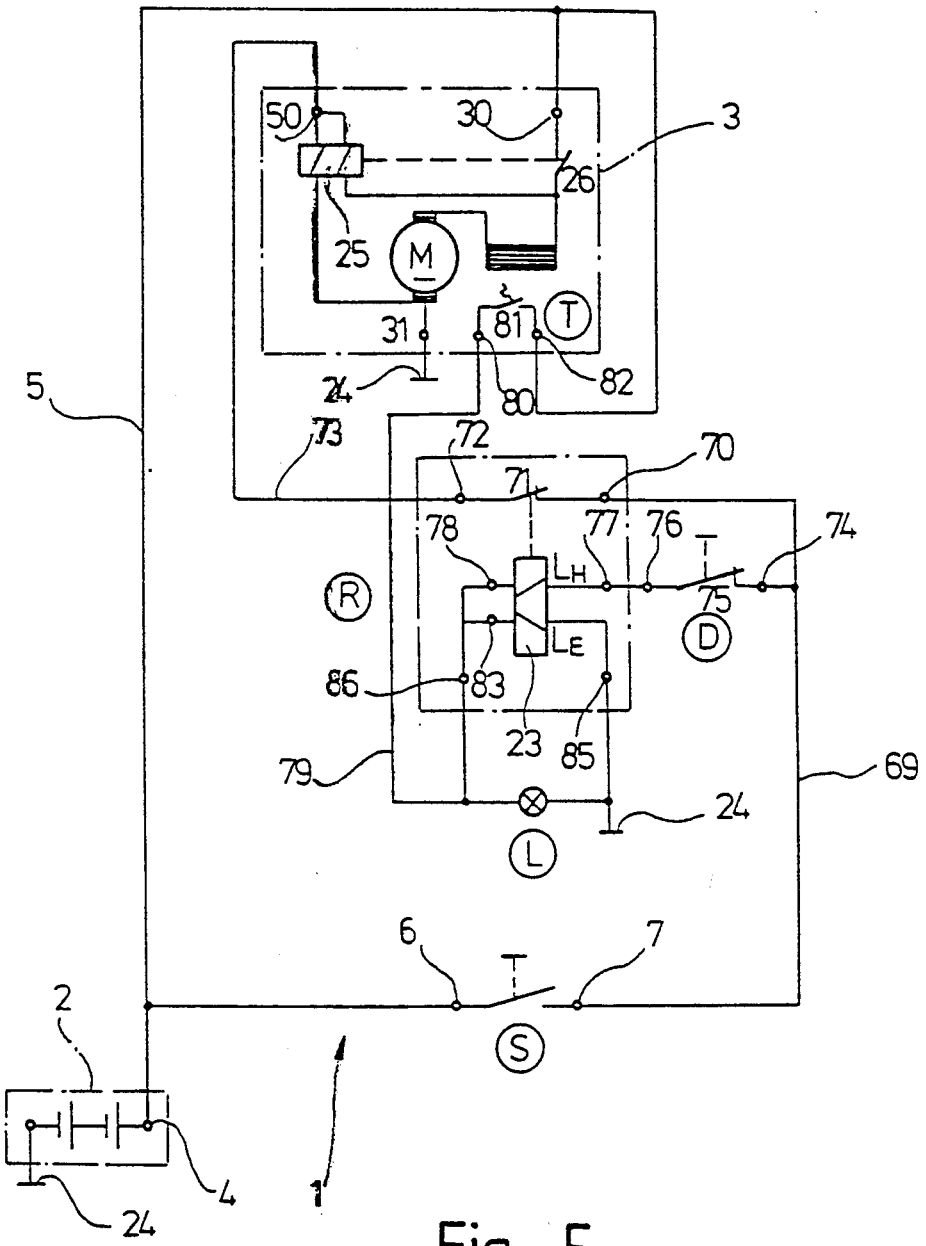
FIG. 5 shows a last illustrative embodiment of a starter protection circuit.

FIG. 5, finally, shows a further illustrative embodiment of a starter protection circuit 1 according to the invention, in which one connection 70 of a normally-closed contact 71 of the relay R is connected to the starter-side pole 7 of the start switch S via a line 69. The other connection 72 of the normally-closed contact 71 is connected via a line 73 to the terminal 50 of the starter 3. The pole 7 is furthermore connected to one pole 74 of the relay operating key D which is constructed as normally-closed contact 75. The other pole 76 leads to the winding 23 of the relay R. This winding 23 is constructed of two parts. It consists of a holding winding $L_E$ and of an operating winding $L_E$. The pole 76 is connected to a terminal 77 which leads to one connection of the holding winding $L_E$. The other connection 78 of the holding winding $L_H$ is connected to the terminal 86 which leads via a line 79 to one pole 80 of the thermoswitch T which exhibits a normally-open contact 81. The other pole 82 of the thermoswitch T leads to the terminal 30 of the starter 3.

The terminal 86 is furthermore connected to a connection 83 which leads to one end of the operating winding $L_E$ of the relay R. The other winding end of the operating winding $L_E$ is connected to the terminal 85. The pilot lamp L is connected in parallel with the terminals 85 and 86, and the terminal 85 also is connected to earth 24.

The following operation is performed: When the start switch S is operated, the starter relay 25 is supplied via the closed normally-closed contact 71 so that the starter 3 begins to operate. Although the terminal 74 is connected to the positive pole 4 of the battery 2 in this operation and, accordingly, a circuit is built up which leads via the relay operating key D, the holding winding $L_E$ and the operating winding $L_E$ to earth 24, the relay R will not operate since the operating winding $L_E$ and the holding winding $L_E$ are of bifilar construction and current flows through them in the opposite direction.

If a fault occurs, the normally-open contact 81 of the thermoswitch T closes, and a result the positive potential of the battery 2 reaches the terminal 86. This positive potential is also present in approximately the same magnitude at the terminal 77 so that the holding winding $L_E$ is not excited. On the other hand, however, the operating winding $L_E$ of the relay R is excited so that the relay R operates, and as a result the normally-closed contact 71 opens so that the starter relay 25 drops out and starter operation is discontinued.

After a certain cooling time, the normally-open contact 81 of the thermoswitch T opens. If the starter is now to be operated again, the relay operating key D is pressed as a result of which voltage is removed from the relay R, which drops out.

The normally-closed contact 71 passes back into its closed state so that the starter relay 25 is activated.

The starter protection circuits according to the invention thus provide a protection function when ignition switches hang up or similar. The starter is protected against total loss. The triggering of the protection function is signalled by the pilot lamp L. A further start can occur however when the start switch S has been repaired or in emergencies the relay operating key D is pressed.

It will be understood that each of the elements described above, or two or more together, may also find a useful application in other types of constructions differing from the types described above.

While the invention has been illustrated and described as embodied in a starter protection circuit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A starter protection circuit for a starting device of an internal combustion engine of a vehicle, comprising a thermoswitch assignable to a starter; a relay which is activated by said thermoswitch when said thermoswitch is operative and interrupts a starter operation; and a relay operating key which after assumption of a cold switching state of said thermoswitch can operate again the starter, said relay has a self-holding circuit.

2. A starter protection circuit as defined in claim 1, wherein said self-holding circuit has a self-holding switching circuit, said relay operating key having a normally-closed contact which is located in said self-holding switching circuit of said self-holding circuit.

3. A starter protection circuit as defined in claim 1, wherein said thermoswitch has a normally-open contact which operates when a limit temperature is exceeded.

4. A starter protection circuit as defined in claim 1; and further comprising a self-holding switching circuit, a start switch, and a starter relay having a circuit, said relay having a normally-open contact and a normally-closed contact, said normally-open contact of said relay being located in said self-holding switching circuit, said normally-closed contact of said relay following said start switch and being arranged in said circuit of said starter relay.

5. A starter protection circuit as defined in claim 1, wherein said thermoswitch and said relay each have a normally-open contact, said normally-open contact of said thermoswitch being connected in parallel with said normally-open contact of said relay.

6. A starter protection circuit as defined in claim 1; and further comprising a start switch having a starter-side pole and a starter relay, said relay having a normally-closed contact and a winding, said thermoswitch having a change-over switch, said change-over switch having a change-over contact located in series with said start switch, a pole connected to said change-over contact in a cold switching state and connected via said normally-open contact of said relay to said starter relay, and a pole connected to said change-over contact in a hot switching state and leading to said winding of said relay.

7. A starter protection circuit as defined in claim 1; and further comprising a start switch having a starter-side pole, and a starter relay, said relay having an operating winding and a holding winding each having one connection and another connection, said relay also having normally-closed contacts, said thermoswitch having a normally-open contact with one pole which leads to a battery of a vehicle and another pole which leads to said one connection of said operating and said holding windings of said relay, said another connection of said holding winding being connected via said normally-closed contact of said relay operating key to said starter-side pole of said start switch and also leads via said normally-closed contact of said relay to said starter relay, said another connection of said operating winding being connected to the battery.

8. A starter protection circuit as defined in claim 7, wherein said one pole of said normally-open contact leads to a positive pole of said battery, while said another connection of said operating winding is connected to a negative pole of said battery.

9. A starter protection circuit as defined in claim 7, wherein said another connection of said operating winding has a terminal connected to said battery.

10. A starter protection circuit for a starting device of an internal combustion engine of a vehicle, comprising a thermoswitch assignable to a starter; a relay which is activated by said thermoswitch when said thermoswitch is operative and interrupts a starter operation; a relay operating key which after assumption of a cold switching state of said thermoswitch can operate again the starter; and a start switch and a starter relay, said relay having a normally-closed contact and a winding, said relay operating key having a normally-closed contact, said thermoswitch having a normally-closed contact, with one first pole connected to said start switch and another second pole connected via said normally-closed contact of said relay of said starter relay, said another second pole being connected to one end of said winding of said relay via said normally closed contact while another end of said winding being connected via said normally-closed contact of said relay operating key to said starter-side pole of said start switch.

11. A starter protection circuit as defined in claim 10, wherein said one end of said winding of said relay has a terminal which is connected to said second pole of said normally-closed contact, said other end of said winding of said relay having another terminal which is connected via said normally-closed contact of said relay operating key to said starter-side pole of said start switch.

12. A starter protection circuit for a starting device of an internal combustion engine of a vehicle, comprising a thermoswitch assignable to a starter; a relay which is activated by said thermoswitch when said thermoswitch is operative and interrupts a starter operation; a relay operating key which after assumption of a cold switching state of said thermoswitch can operate again the starter; and a pilot lamp indicating a position of said relay.

* * * * *